United States Patent [19]

Takahashi et al.

[11] 4,395,111

[45] Jul. 26, 1983

[54] SHEET CONVEYING DEVICE

[75] Inventors: Yuji Takahashi, Tokyo; Hisaji Masaki, Kawasaki, both of Japan

[73] Assignee: Canon Kabushiki Kaisha, Tokyo, Japan

[21] Appl. No.: 296,257

[22] Filed: Aug. 26, 1981

[30] Foreign Application Priority Data

Aug. 28, 1980 [JP] Japan ..... 55/118612
Aug. 28, 1980 [JP] Japan ..... 55/118613

[51] Int. Cl.[3] ..... G03G 15/00

[52] U.S. Cl. ..... 355/14 R; 355/3 SH; 355/14 SH

[58] Field of Search ..... 355/14 SH, 14 R, 14 CU, 355/14 C, 3 R, 3 SH

[56] References Cited

U.S. PATENT DOCUMENTS 4,239,372 12/1980 Iwai ..... 355/14 R
4,244,648 1/1981 Schultes et al. ..... 355/14 R
4,247,193 1/1981 Kaneko et al. ..... 355/14 R

*Primary Examiner*—A. C. Prescott
*Attorney, Agent, or Firm*—Fitzpatrick, Cella, Harper & Scinto

[57] ABSTRACT

A conveying device for sheet material used in combination with reproduction apparatus, which is constructed with a sheet conveying pathway, a sheet conveyor to convey a sheet along the conveying pathway, abnormal feeding detector to detect that the sheet is abnormally conveyed along the conveying pathway, a jam detector provided on one part of the sheet conveying pathway at a position backward of the abnormal feeding detector, and to detect the sheet jam, and a control device to control the jam detection operation by the jam detector when the abnormal feeding is detected by the abnormal feeding detector.

22 Claims, 8 Drawing Figures

SHEET CONVEYING DEVICE

BACKGROUND OF THE INVENTION

1. Field of the Invention

This invention relates to a sheet material conveying device adapted for use in a recording apparatus such as reproduction apparatus, laser beam printer, etc. More particularly, the invention is concerned with a conveying device capable of so controlling as to reduce jamming frequency of cut sheets as recording material in a conveying path of the recording apparatus when the sheets are fed irregularly through the conveying path such as a plurality of sheets being fed in superposition (hereinafter referred to as "plural feeding").

2. Description of Prior Arts

In these several years, printing speed of the reproduction apparatus and laser beam printer have been increased more and more, some of which are able to print as many as 100 sheets or more per minute of A-4 size paper. While such highspeed reproduction apparatus produces a large number of reproduced sheets per unit time, as an output, conveyance of the sheets for reproduction becomes unstable with the result that jamming frequency of the sheet tends to increase only for trifling reasons of its curling, moistening, and others. On account of this, it becomes difficult to make the best use of the high speed operation of the reproduction apparatus, and a throughput (or processing capability) of the machine is rather low. In addition, since the high speed machine receives a larger inertial load in its driving system than a low speed machine, a longer time is taken until the machine stops when the sheet jamming is detected. As the consequence of this, the feeding sheet is apt to be drawn into the conveying path in a longer length. On the other hand, if the jam detection timing is advanced, the machine indicates a jam detection with even a slight delay in the sheet feeding, and the machine is inevitably stopped in its operation in spite of the sheet having actually not been jammed.

Moreover, in the reproduction apparatus of a type, wherein cut sheets are used for the reproduction, plural feeding or slant feeding of the sheets causes jamming. In particular, plural feeding readily takes place when the surface of the cut sheet has a frictional coefficient different from the other surface thereof, i.e., it occurs on the surface of the cut sheet which has been in contact with wrapping paper for it. For instance, when a package of cut sheets consisting of 500 sheets is stacked in a large capacity sheet feeding device used in a high speed reproduction apparatus, such plural feeding of the sheets will take place at a rate of once every 500 sheets or so. Also, the plural feeding is prone to occur in the sheets stacked at the bottom portion of a paper feeding deck or paper feeding cassette, which readily brings about the jamming.

Usually, when plural feeding occurs, the numbers of sheet fed range from two to ten or so. As the number of sheets increases in the plural feeding, the sheet conveyance becomes difficult. In particular, when the feeding sheet is stopped for an instant as at a registering section in the reproduction apparatus, such instantaneous stoppage rather causes jamming. Even if there takes place no jamming at all, as the sheet cannot be uniformly sent out of the registering section, the sheet feeding is delayed, and this delay is determined as jam due to delay (or delay jam).

SUMMARY OF THE INVENTION

It is therefore an object of the present invention to provide a highly reliable sheet conveying device for use in the reproduction apparatus, which removes the abovementioned various drawbacks inherent in the conventional device, and prevents sheet jamming from taking place due to plural feeding.

It is another object of the present invention to provide the sheet conveying device capable of preventing erroneous jam detection due to plural feeding by delaying a jam check timing as soon as plural feeding is detected.

It is still another object of the present invention to provide the sheet conveying device which is capable of not only reducing frequency of the sheet jamming to occur at the registering section in the reproduction apparatus by continuously forwarding the sheets without performing registering action therefor even when plural feeding is detected, but also preventing erroneous detection of sheet jamming due to plural feeding.

The foregoing objects, other objects, detailed construction and operations of the sheet conveying device according to the present invention will become more apparent and understandable from the following description of the invention, when read in conjunction with the accompanying drawing.

BRIEF DESCRIPTION OF THE DRAWING

In the drawing:

FIGS. 3-1 and 3-2 are respectively control block diagrams;

DETAILED DESCRIPTION OF THE PREFERRED EMBODIMENTS

Figure 1:
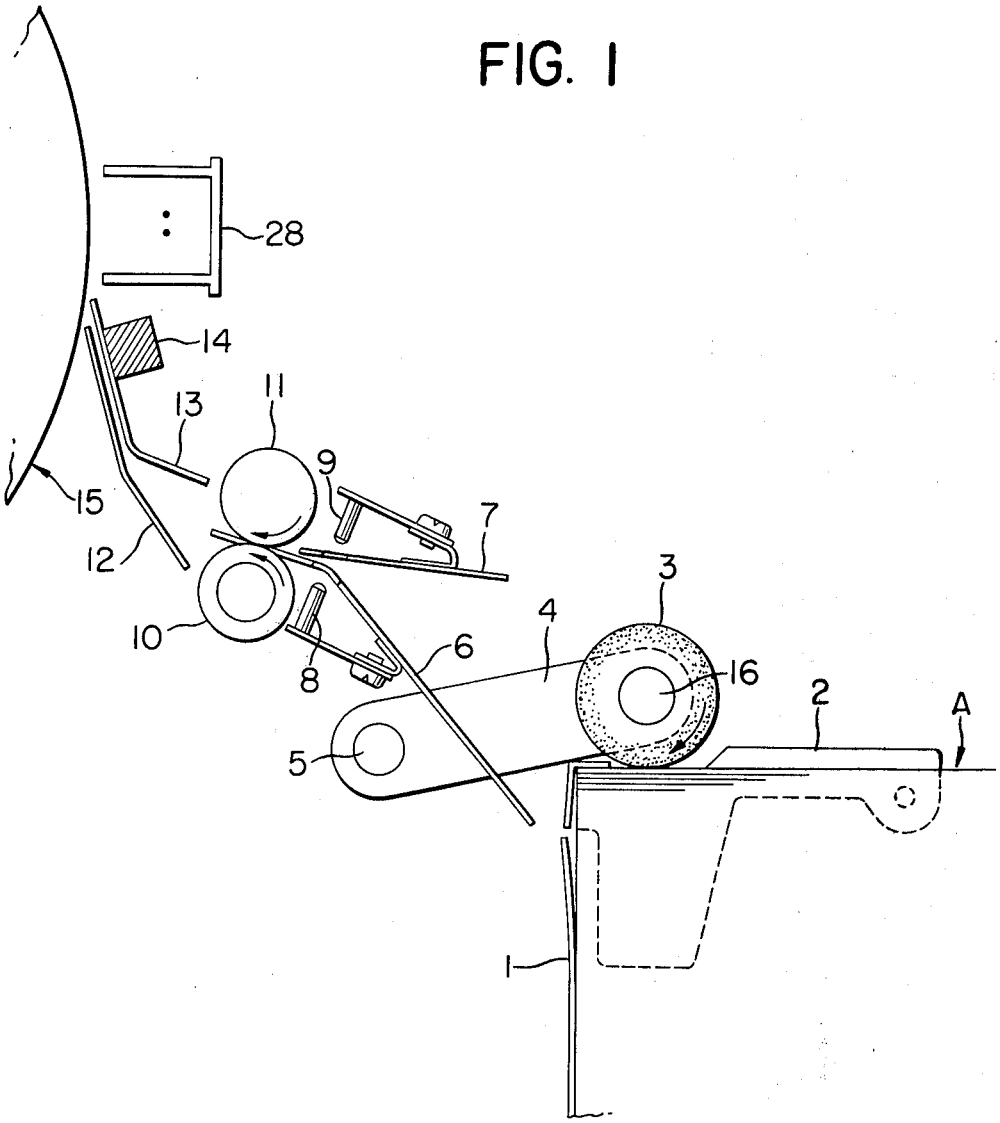
FIG. 1 is a schematic side elevational view of a sheet feeding mechanism and its neighboring region.

Referring first to FIG. 1 showing the side elevational view of the sheet feeding mechanism and its neighboring region in the reproduction apparatus, the laser beam printer, and so forth, the cut sheets A are stacked in a sheet feeding deck 1, the topmost sheet being pressed down lightly at its forward end with a separating pawl 2. A sheet feeding roller 3 mounted on a shaft 16 is in contact with the top surface of the cut sheet A in a freely oscillatable manner by an arm 4 pivoted on a pin 5. When the sheet feeding roller 3 rotates in an arrow direction in the drawing, the topmost sheet is separated from the stack, passes through a pair of sheet feeding guides 6, 7, and fed into a pair of rollers consisting of a register roller 10 and an urging roller 11. The sheet feeding guides 6, 7 are respectively provided thereon with a light receiving sensor 8 and a light emitting lamp 9, with which a quantity of light emitted from the lamp 9, transmitted through holes formed in both sheet feeding guides and the sheet as conveyed therebetween, and reaching the sensor 8 is measured. The cut sheet with its forward end having been positioned by the register roller 10 is then conveyed into guides 12, 13. During its conveyance through the guides 12, 13, delay in the sheet conveyance is sensed by a reflection-type sensor 14 provided on the guide 13. After checking its delay, the sheet is further conveyed along a photosensitive drum 15, while it is receiving transfer of a toner image formed on the photosensitive drum by means of an image transfer charger 28.

Figure 2:
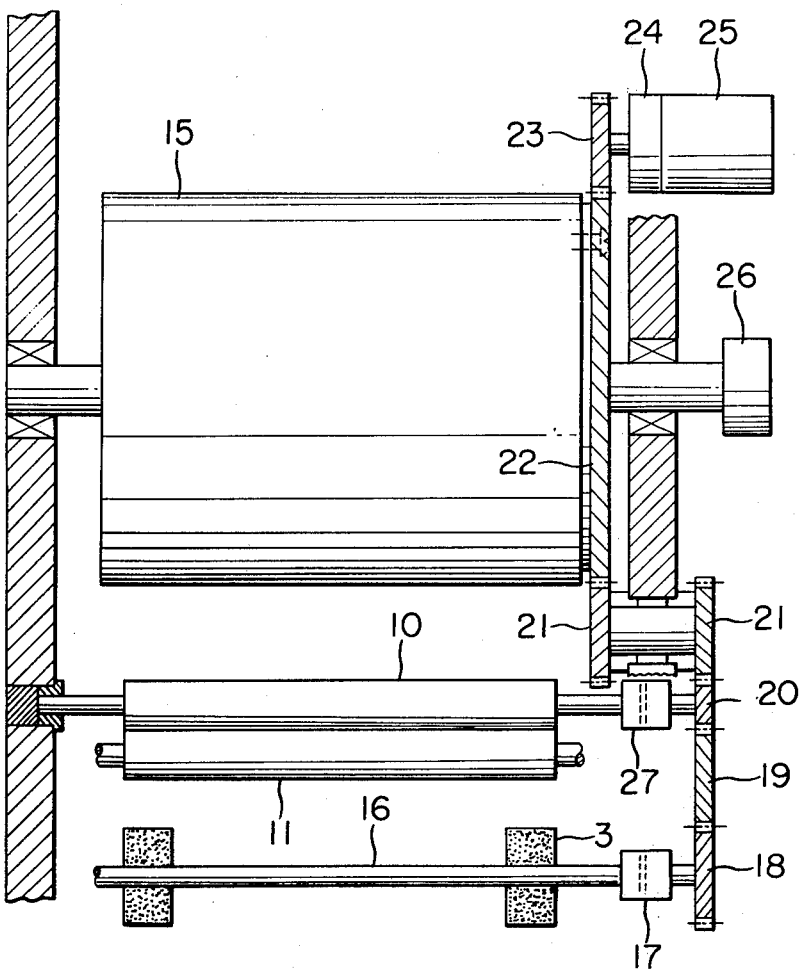
FIG. 2 is a schematic plan view of the sheet feeding system.

Referring to FIG. 2 showing a schematic plan view of the sheet conveying system, a slow-down device 24 is connected with a drive motor 25. Rotational force of the drive motor 25 is transmitted to a drum gear 22 through a driving gear 23 provided on the output shaft of the slow-down device 24.

The photosensitive drum 15 has a clock disc (not shown) which rotates with rotation of the drum. By optically detecting clock points on the disc with a sensor, clock pulses are generated to control each and every stage of the image forming cycle. The drum gear 22 further rotates a register gear 20 through an intermediate gear 21. A clutch 27 is interposed between the register gear 20 and the register roller 10 to effect the registering operation of the feeding sheet by on-and-off operation of the clutch. Rotation of the register gear 20 is transmitted to a sheet feeding gear 18 through an idler gear 19. A sheet feeding roller clutch 17 is mounted on the sheet feeding shaft 16 adjacent to the sheet feeding gear 18. By the on-and-off operation of the clutch 17, the sheet feeding is intermittently effected.

Figures 1, 3:
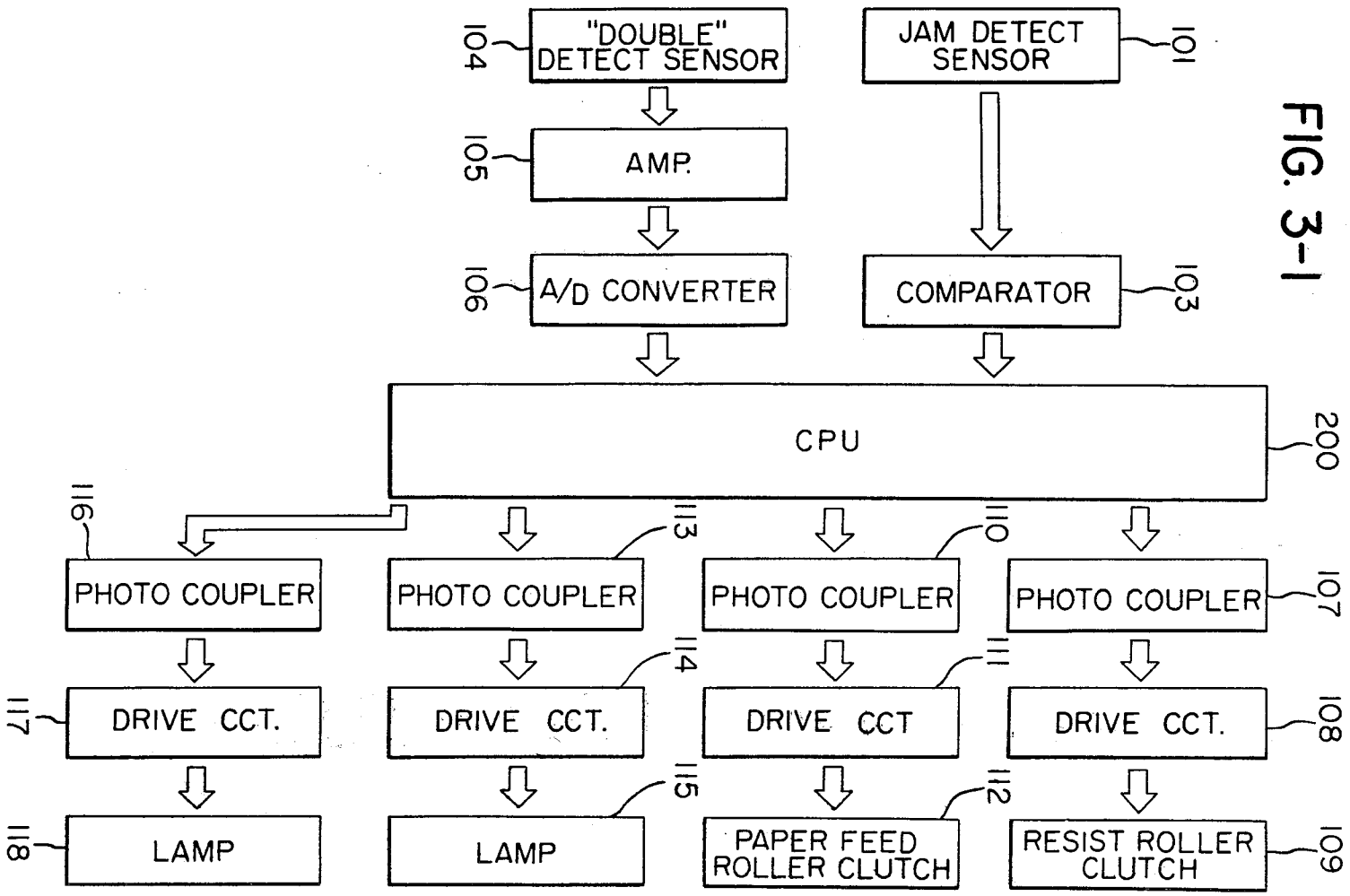
Figures 2, 3:
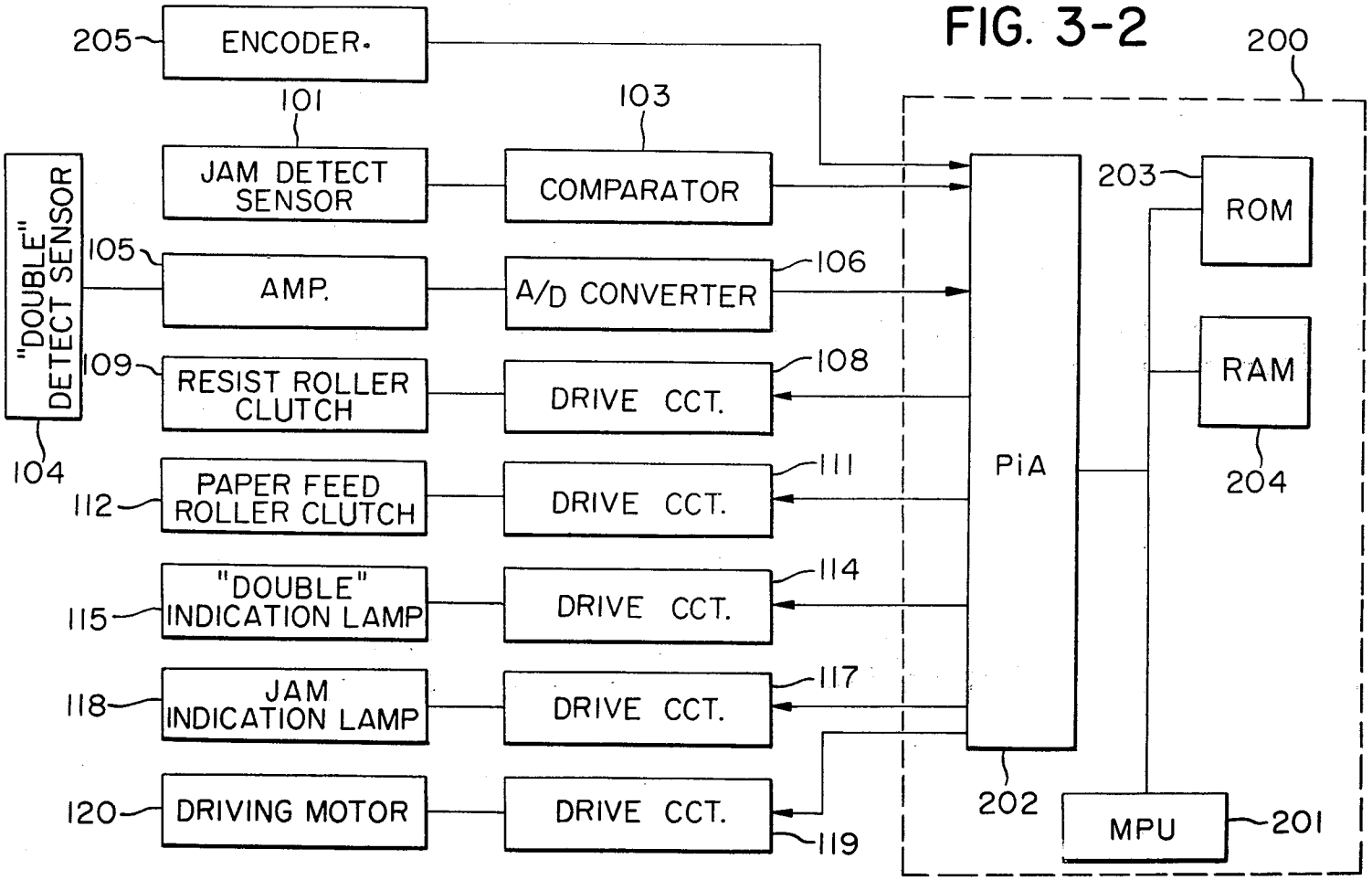

FIG. 3-1 shows a sheet feeding control section of the reproduction apparatus. An output signal from a jam detector circuit 101 consisting of the reflection-type sensor 14 is input into a comparator 103. The detection output is compared in the comparator 103 with a voltage at a certain definite level, is binarized, and introduced as an input into a central operational processing unit 200 (hereinafter abbreviated as "CPU"). An output signal from a plural feeding sensor circuit 104 consisting of the light receiving sensor 8 and the light emitting lamp 9 is amplified by an amplifier circuit 105, and then input into an A/D converter 106. The detection output is converted by the A/D converter 106 into a digital quantity from an analog quantity, after which it is input into the CPU 200. The CPU 200, based on these input signals, determines the plural feeding or sheet jamming. On the basis of the result of this determination, a control signal output is produced from the CPU 200, with which driving circuits 108, 111, 114 and 117 are turned on and off through respective photo-couplers 107, 110, 113 and 116 to control operations of a register roller clutch 109 (corresponding to the part 27 in FIG. 2), a sheet feeding roller clutch 112 (corresponding to the part 17 in FIG. 2), a lamp 115 to indicate the plural feeding, and a lamp 118 to indicate the sheet jamming.

Figures 4, 4A:
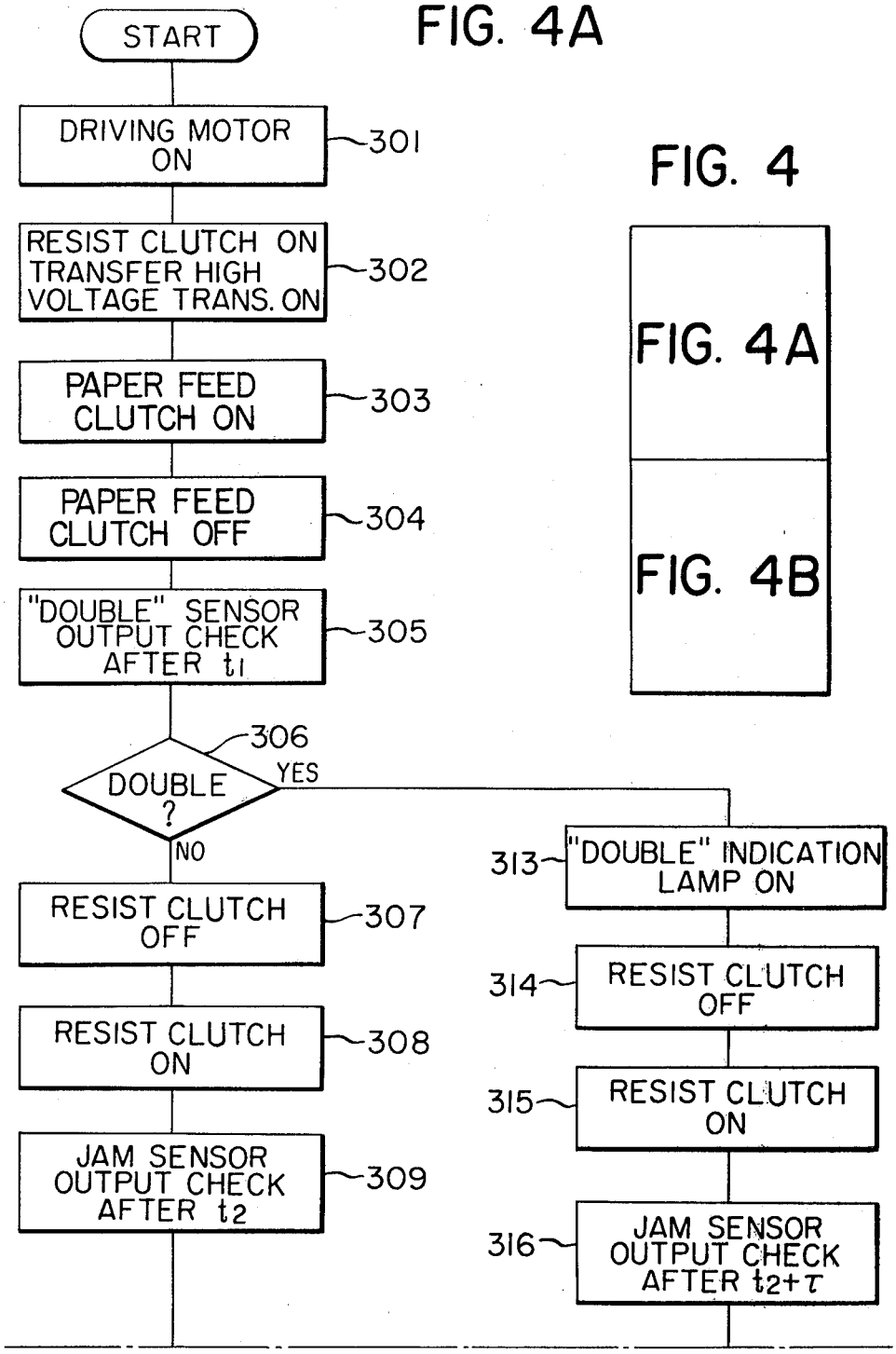
FIGS. 4 and 6 are respectively control flow charts and are shown in two parts each, 4A, 4B and 6A, 6B.
Figure 4B:
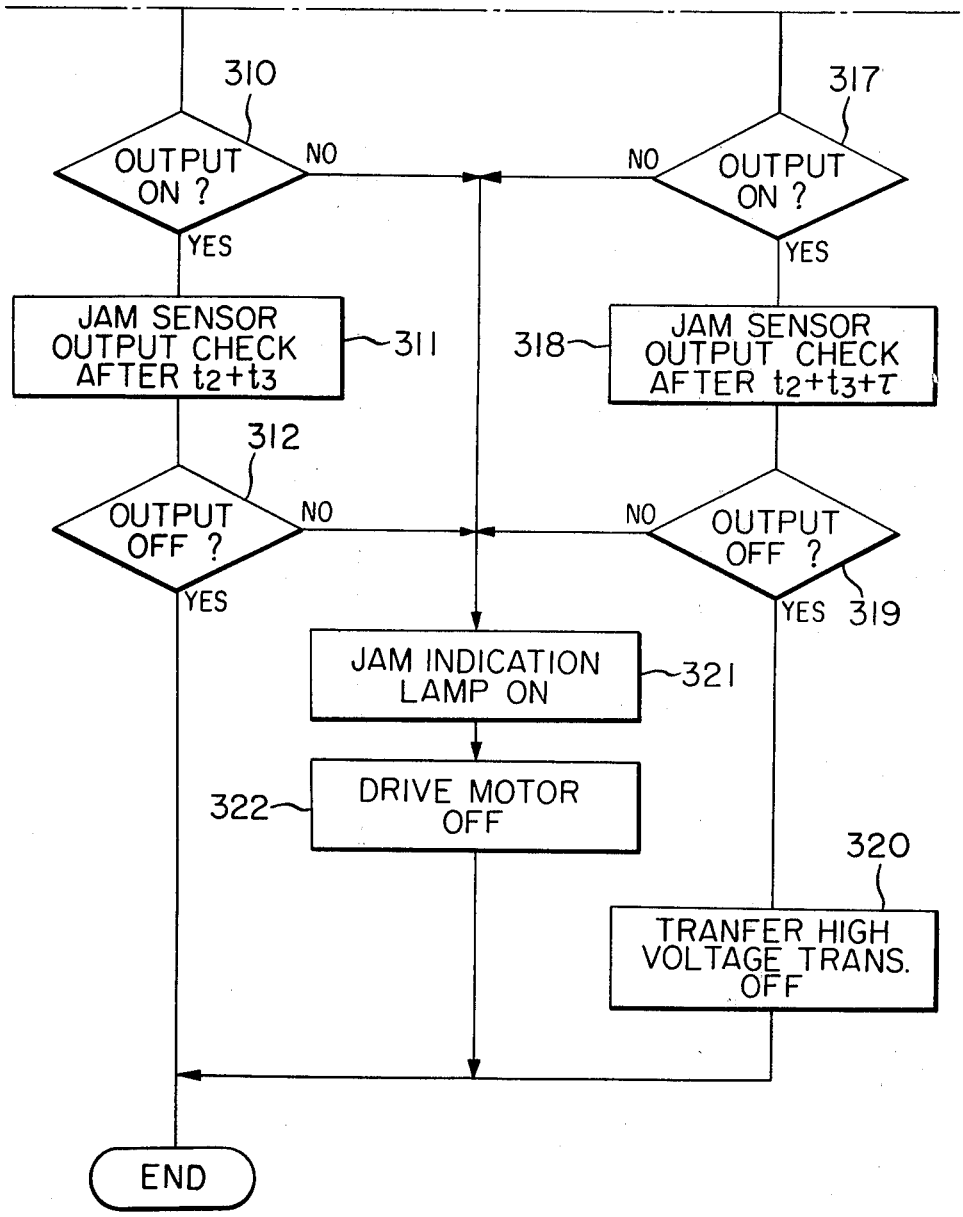
Figures 6, 6A:
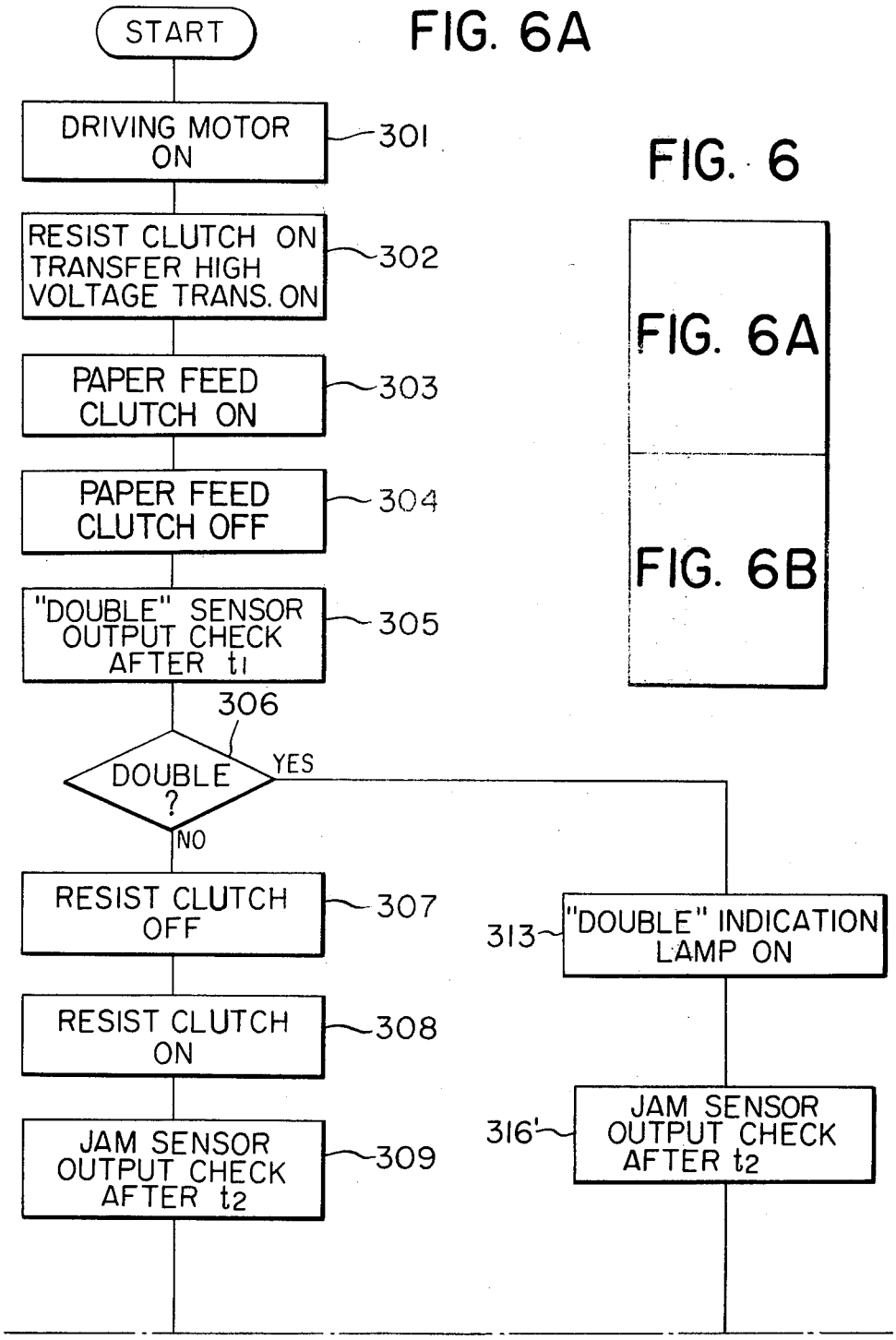
Figure 6B:
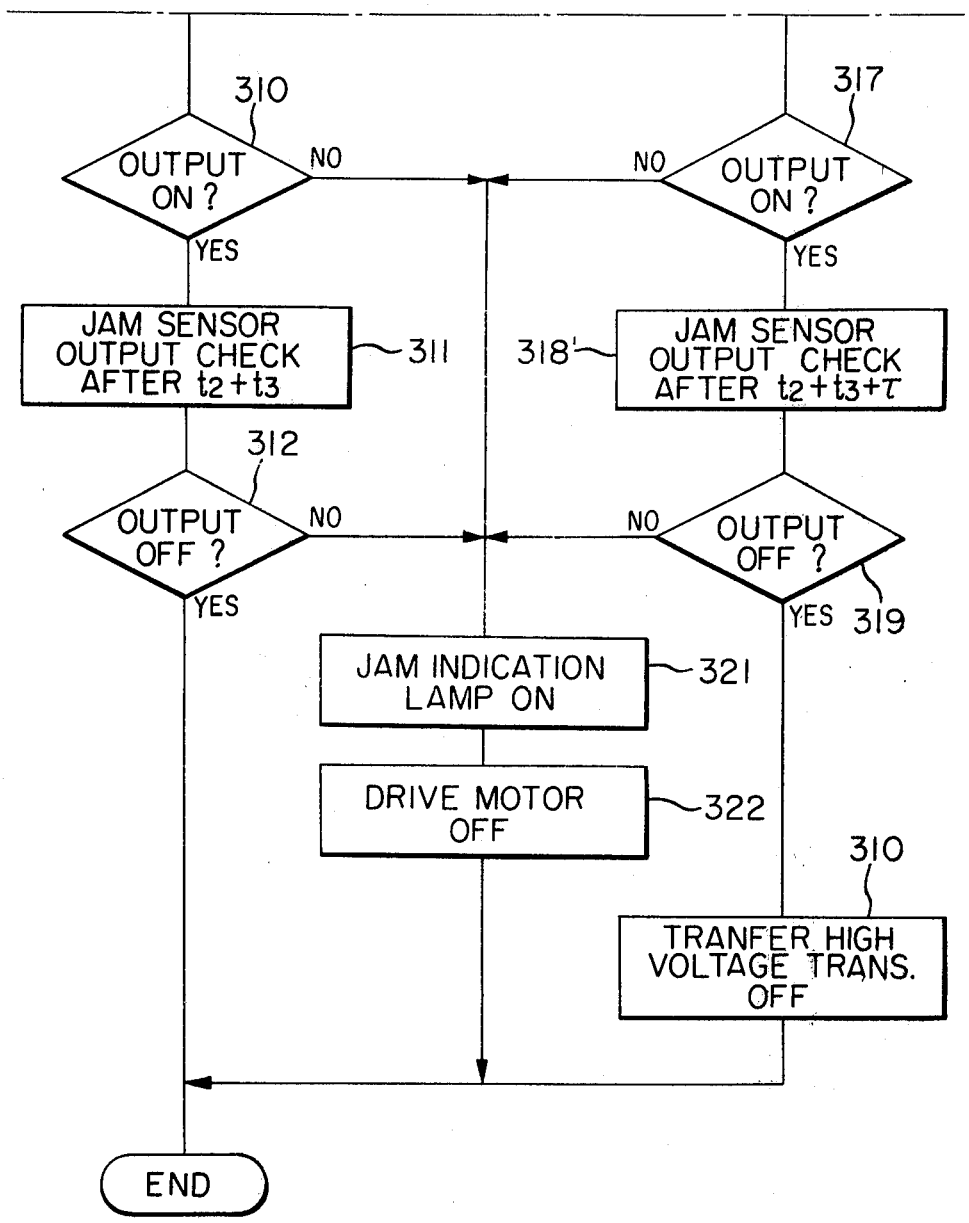

FIG. 3-2 shows further details of the control section shown in FIG. 3-1, wherein the CPU 200 is constructed with a micro-processing unit (MPU) 201 as the key component, a peripheral interface adaptor (PIA) 202 which functions as an interface component for input and output devices to interact with the MPU 201, a read-only memory (ROM) 203 which stores therein a control program for the MPU 201 (e.g., as formulated in accordance with the flow charts shown in FIGS. 4 or 6), and a random access memory (RAM) 204 capable of performing both reading and writing.

A clock pulse generated from an encoder 205 as the result of the drive motor rotation being detected by the clock disc and a photo-interrupter, etc. is introduced as an input into the PIA 202. Also, with the PIA 202, there are connected the jam detection circuit 101, the plural detection circuit 104, the register roller clutch 109, and sheet feeding clutch 112, the plural feeding indication lamp 115, the jam indication lamp 118, and the driving motor 120 (corresponding to the part 25 in FIG. 2). These are controlled in accordance with the program stored in the ROM 203.

The above-described system can be constructed with, for example, a micro-computer family M6800 (MPU . . . MV6800, PIA . . . MC6820, and so forth) of Motorola Inc.

Figure 5:
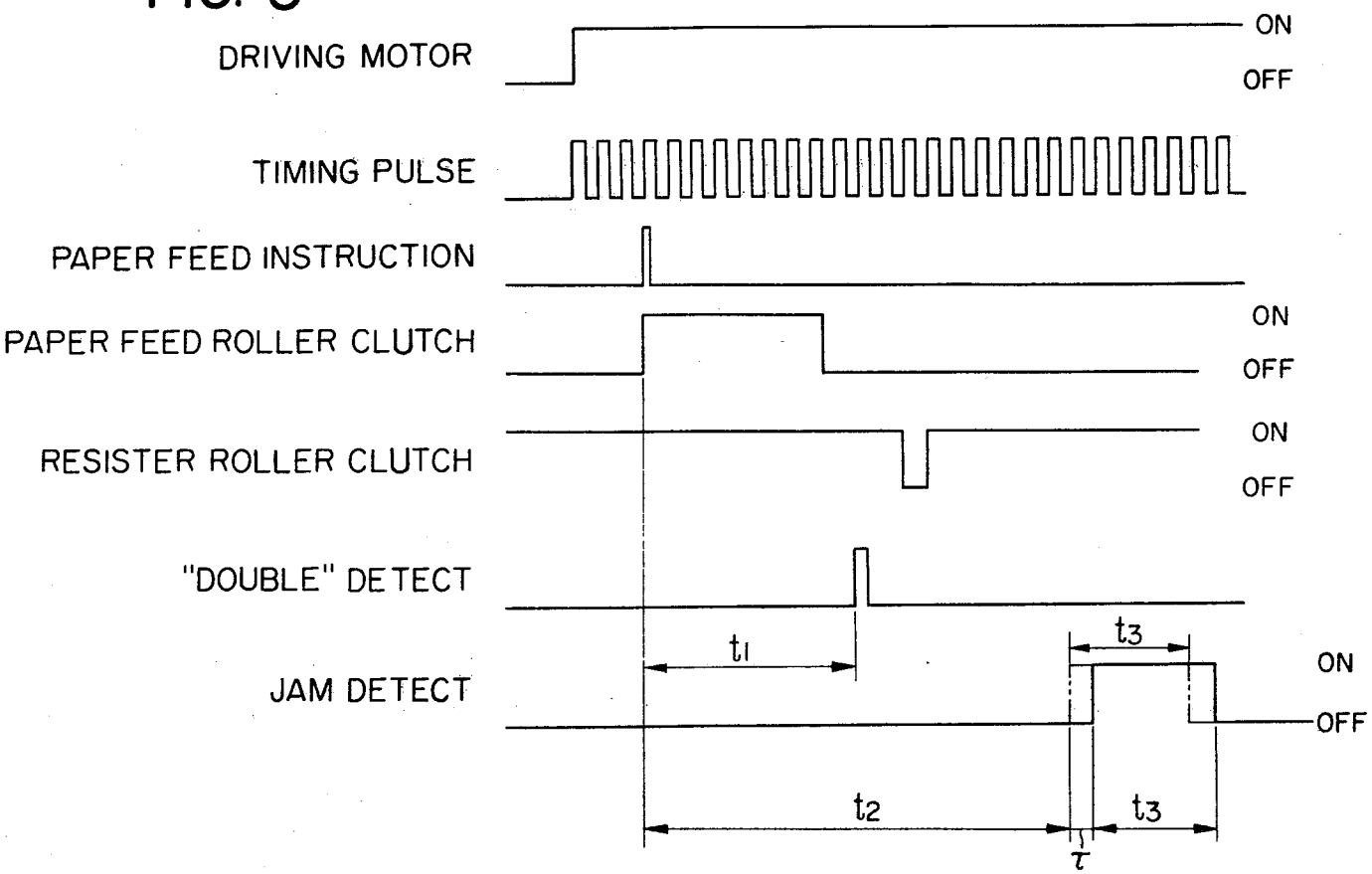
FIGS. 5 and 7 are respectively control timing charts.

FIG. 4 illustrates a flow chart for controlling the jam check timing at the plural feeding. In the ROM 203 shown in FIGS. 3-2, there is stored a program formulated in accordance with this control flow chart. The MPU 201 controls the operations of every part in accordance with this program. FIG. 5 is a timing chart for this control flow chart.

In the following, the operations of the control section will be explained in reference to the flow chart in FIG. 4 and the timing chart in FIG. 5.

When the drive motor 25 is actuated at the step 301, the photosensitive drum 15 starts rotation, whereby a clock pulse is generated as mentioned in the foregoing. This clock pulse is input into the CPU 200, and all the sequence controls are effected with this clock pulse as a reference.

At the step 302, a high tension transformer (not shown) is turned on to drive the register roller clutch 27 and the image transfer charger 28. Next, when the clock pulse has counted a predetermined number, a paper feeding instruction output is produced from the CPU at the steps 303, 304, whereby the sheet feeding roller clutch 17 is actuated, and the sheet feeding roller 3 starts driving. After a lapse of time $t_1$ since the sheet feeding instruction has been output at the step 305—i.e., immediately before arrival of the sheet at the register roller 10, the detection of plural feeding is performed. This detection is done in such a manner that, in case a plurality of sheets are conveyed with a slight slippage among them, for example, variations in the transmitted light quantity, at the time of passage of the sheets through and between the light emitting lamp 9 and the light receiving sensor 8, are detected by the detector circuit 101. In other words, by introducing a light detection signal, as an input, from the light receiving sensor 8 into a differential circuit, a plurality of pulses can be generated with timings corresponding to such slippage in the sheets, and the plural feeding can be detected with the pulses. Details of this detection method are described in Japanese patent application No. 51-76746 (Japanese laid-open patent application No. 53-3279), hence reference may be had to the specification of this prior application.

If no plural feeding is detected at the step 306, a control signal output is produced from the CPU 200 at the step 307, whereby the register roller clutch 27 is disconnected, the register roller 10 stops its rotation, and the forward end of the sheet is positioned. Subsequently, at the step 308, the register roller 10 resumes its rotation after lapse of a certain predetermined time, and the sheet is conveyed in and between the guides 12, 13. After lapse of time $t_2$ since the sheet feeding instruction has been output, a delay jam is checked by the reflection-type sensor 14 at the steps 309, 310. When the feeding sheet is detected, the CPU 200 determines that there is no delay jam taken place. After lapse of time $t_3$, i.e., at the step 311, 312, when no sheet feeding is detected, the CPU determines that there is no detention jam taken place. In case the delay jam or the detention jam is detected at the step 310 or 312, the jam indication lamp 118 is turned on by an output signal from the CPU 200 at the step 321 to indicate the jam, and, at the same time, necessary controls of operations such as stoppage of the apparatus by stopping the drive motor 25, and so on are effected at the step 322.

When plural feeding has been detected, the jam check timing is delayed by a time $\tau$. In more detail, as soon as the plural feeding is detected at the step 306, the jam indication lamp 118 is turned on at the step 313 to indicate the plural feeding. After performing on-off operations of the register roller clutch 27 with ordinary timing at the steps 314, 315, an output from the jam sensor 14 is checked after lapse of time $t_2+\tau$. When the feeding sheet is detected at the step 317, the CPU 200 determines that no delay jam has taken place. After lapse of time $t_2+t_3+\tau$, the output from the jam sensor 14 is again checked. If no sheet is detected, the CPU determines that no detention jam has taken place. When the delay jam or the detention jam is detected at the step 317 or 319, the jam indication lamp 118 is turned on at the steps 321, 322, and the apparatus is stopped by deactuating the drive motor 25 as already mentioned in the foregoing.

In this manner, when plural feeding occurs, if the jam check is effected with an ordinary timing, it occurs that the sheet conveyance becomes difficult and the delay is caused, or that the sheet is detected even after lapse of the jam detection time $t_3$ to determine the jam. However, delay by $\tau$ in the timing which verifies whether the sheet is at the position of the sensor 14 or not, for the purpose of the jam detection, makes it possible to prevent such erroneous detection as mentioned above from occurring.

Incidentally, the delay time $\tau$ can be readily found out empirically from the sheet conveying speed, sheet size, characteristics of the jam detector, and others.

Figure 7:
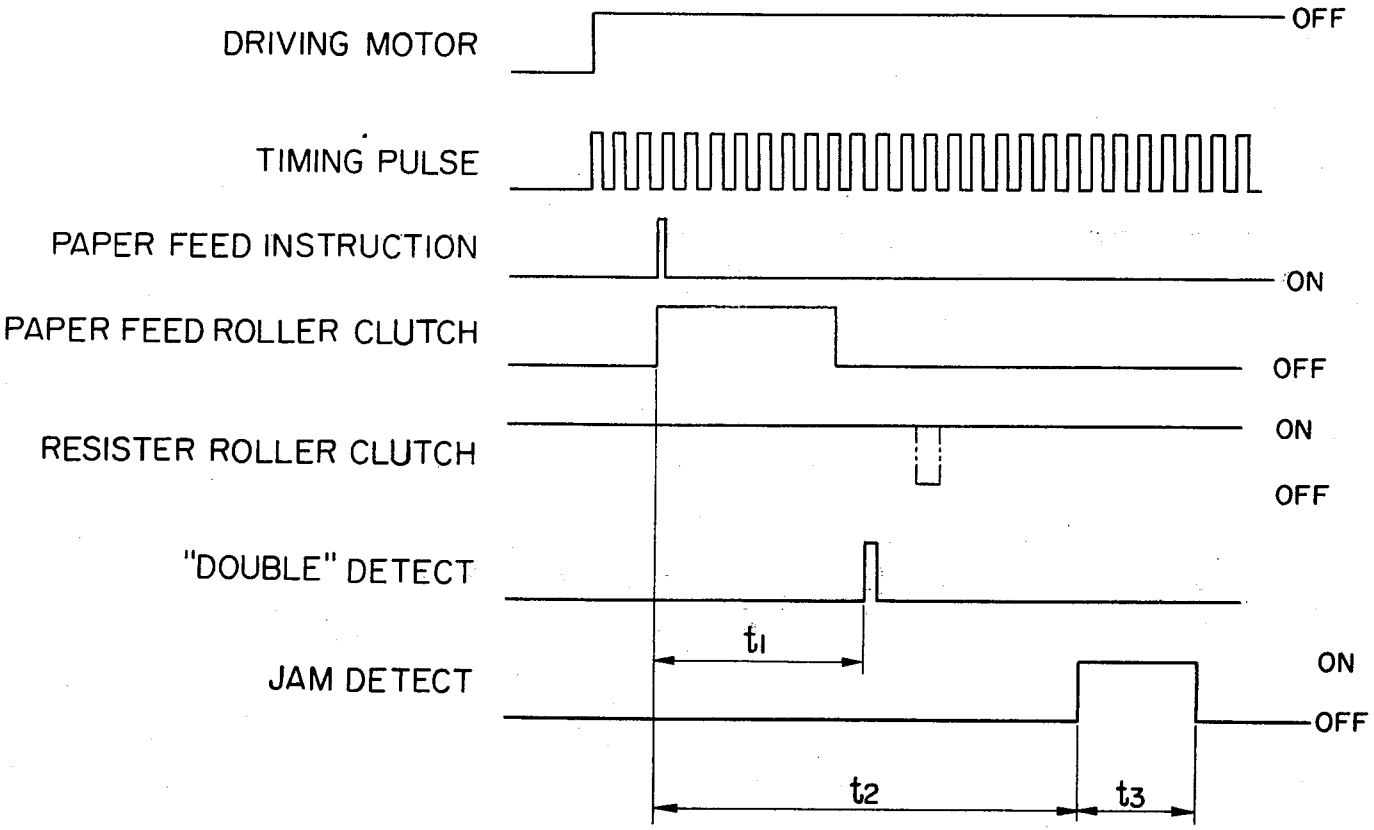

It is also possible to construct this sheet feeding control section in such a manner that, even when plural feeding has been detected, the feeding sheets are continuously forwarded, as they are, without stopping rotation of the register roller 10, which contributes to reduction in frequency of the jam to occur at the registering section. FIGS. 6 and 7 illustrate the control flow chart and the timing chart, respectively, for such mode of operation.

When plural feeding is detected at the step 306, the plural feeding indication lamp 115 is turned on at the step 313. However, no output signal to disconnect the register roller clutch 27 is produced from the CPU 200, as shown by a solid line in FIG. 7, and the register roller 10 continues its rotation, whereby no registering action is effected at the register section, the feeding sheet is forwarded into the guides 12, 13 by means of the register roller 10 and the urging roller 11, and the jam checking is performed by the reflection-type sensor 14 after lapse of time $t_2$ at the step 316'. In case the ordinary detecting position is at the forward edge of the feeding sheet or in the vicinity thereof, as no registering operation is effected at the register section and the sheet is continuously forwarded, as mentioned above, the detecting position comes closer to the center of the sheet for the time portion of the continued sheet advancement. Even this position is sufficient for the purpose at detecting the delay jam. After lapse of time $t_3$ from checking of the delay jam at the steps 318', 319, the detention jam is checked. It is apparent that this detention jam can also be checked without changing the time $t_3$.

By so constructing the control section, the frequency of jamming at the registering section, when plural feeding has been detected, can be remarkably reduced.

At the time when plural feeding is detected, there has already been formed a toner image on the photosensitive drum. It is therefore possible that the toner adhered on the drum can be removed by transferring the toner image onto the sheet in plural feeding while the transfer charger 28 is being operated. It is also possible to construct the control section in such a manner that the transfer charger 28 is rendered inoperative upon detection of the plural feeding so as not to perform the image transfer, whereby the non-image-transferred sheet can be re-used. In this case, the timing to render the transfer charger 28 inoperative should be made to correspond to a timing for completing the image transfer onto a preceding sheet which is regularly fed. This can be attained by interrupting the electric conduction to the image transfer charger 28 with a logic "AND" being taken between a plural feeding detection signal and an image transfer section passage signal of the preceding sheet (a signal produced when the rear edge of the sheet has passed through the sensor 14).

In case of using a sheet having perforations in it, erroneous jam detection to occur possibly due to such perforations can be prevented by making the jam check timing variable by means of, for example, the key input.

So far, the present invention has been explained with reference to plural feeding of the sheet. However, the foregoing explanations can be equally applied to other abnormal feeding such as slant feeding of the sheet.

What we claim is:

1. A conveying device, comprising:

(a) a sheet conveying pathway;

(b) sheet conveying means for conveying a sheet along said conveying pathway;

(c) abnormal feed detection means for detecting that the sheet is abnormally conveyed along said conveying pathway;

(d) jam detection means for detecting sheet jamming, said detection means being provided on one part of said conveying pathway at a position downstream of said abnormal feed detection means; and (e) control means for delaying a jam check timing by said jam detection means for a predetermined time when abnormal feeding is detected by said abnormal feed detection means.

2. A conveying device as set forth in claim 1, wherein said abnormal feed detection means detects plural feeding of sheets.

3. A conveying device as set forth in claim 2, wherein said abnormal feed detection means detects a light quantity transmitted through the sheet.

4. An image forming device, comprising:

(a) storage section, in which sheets are stacked;

(b) image forming means to form an image on a sheet in accordance with an image original;

(c) a conveying pathway to convey the sheet from said storage section to an image forming region;

(d) feeding means for feeding the sheet from said sheet storage section to said sheet conveying pathway;

(e) register means for once stopping the sheet for registering its forward edge with the forward edge of the image, and for feeding said sheet to said image forming region in accordance with a predetermined timing;

(f) feed detection means provided at a position upstream of said register means for detecting that a plurality of sheets are conveyed in superposition;

(g) jam detection means provided between said register means and said image forming region for detecting sheet jam; and (h) control means for controlling the jam detection operation by said jam detection means for a predetermined time, when plural feeding is detected by said feed detection means.

5. An image forming device according to claim 4, wherein said control means stops the image forming operation onto the sheet by said image forming means when plural feeding is detected by said feed detection means.

6. A conveying device, comprising:

(a) a sheet conveying pathway;

(b) sheet conveying means including timing means for forwarding the sheet, which has been conveyed along said conveying pathway, in accordance with a predetermined timing;

(c) abnormal feed detection means provided at a position upstream of said timing means for detecting that the sheet has been abnormally fed; and (d) control means for controlling said timing means so as to forward the sheet without the predetermined timing, when abnormal feeding has been detected by said abnormal feed detection means.

7. A conveying device according to claim 6, wherein said abnormal feed detection means detects plural feeding of sheets.

8. A conveying device according to claim 6 or 7, wherein said abnormal feed detection means detects a light quantity transmitted through said sheet.

9. An image forming device, comprising:

(a) a sheet stacking section;

(b) image forming means for forming an image on the sheet in accordance with an image original;

(c) a conveying pathway to convey the sheet from said sheet stacking section to an image forming region;

(d) feeding means for feeding the sheet from said sheet stacking section to said sheet conveying pathway;

(e) register means for once stopping the sheet for registering its forward edge with the forward edge of the image, and then for feeding the sheet to said image forming region in accordance with a predetermined timing;

(f) plural feed detection means provided at a position upstream of said register means for detecting that a plurality of sheets are conveyed in superposition; and (g) control means responsive to a plural feed detection for controlling said register means so as to feed the sheet to said image forming region without stopping its feeding.

10. An image forming device as set forth in claim 9, wherein said control means stops the image forming operation onto the sheet by said image forming means, when said plural feed detection means detects plural feeding of sheets.

11. An image forming device, comprising:

(a) a sheet conveying pathway;

(b) conveying means for conveying the sheet along said conveying pathway;

(c) jam detection means for detecting sheet jamming in said conveying pathway;

(d) serial pulse generating means;

(e) means for counting pulses from said serial pulse generating means, and producing a timing for the jam detection; and (f) means responsive to an abnormal condition of the device for changing said timing for a predetermined time.

12. An image forming device as set forth in claim 11, wherein said means for changing the timing for a predetermined time is responsive to plural feeding detection.

13. An image forming device as set forth in claim 11, wherein said means for changing the timing for a predetermined time responds to a manual selection.

14. An image forming device according to claim 4, wherein said jam detection operation is a jam check timing.

15. An image forming device according to claim 14, wherein said control means delays said jam check timing.

16. An image forming device according to claim 11, wherein said timing changing means delays said timing.

17. An image forming device according to claim 11, wherein said serial pulse generating means generates serial pulses in accordance with rotation of a photosensitive drum.

18. A conveying device comprising:

(a) a sheet conveying path, (b) sheet conveying means for conveying a sheet along said sheet conveying path including timing means for conveying the sheet in accordance with a predetermined timing;

(c) feed detection means for detecting that a plurality of sheets are conveyed in superposition;

(d) A/D converting means for converting an analog signal from said feed detection means to a digital signal; and (e) control means for controlling the sheet conveying in accordance with the output signal from said A/D converting means wherein said control means controls said timing means to convey the sheet without the predetermined timing when said feed detection means detects that a plurality of sheets are conveyed in superposition.

19. A conveying device according to claim 18, further comprising jam detection means for detecting a jam of the sheet conveyed by said sheet conveying means.

20. A conveying device according to claim 19, wherein said jam detection means is provided on said conveying path at a position downstream of said feed detection means.

21. A conveying device according to claim 20, wherein said control means controls the jam detection operation of said jam detection means.

22. A conveying device according to claim 21, wherein said jam detection operation is a jam detection timing.

* * * * *